US006779307B2

(12) United States Patent
Dobson

(10) Patent No.: US 6,779,307 B2
(45) Date of Patent: Aug. 24, 2004

(54) VEHICLE WINDOW REGULATOR HAVING ANGLED SPROCKETS

(75) Inventor: Simon Dobson, Kent (GB)

(73) Assignee: Meritor Light Vehicle Systems - France (FR)

( * ) Notice: Subject to any disclaimer, the term of this patent is extended or adjusted under 35 U.S.C. 154(b) by 16 days.

(21) Appl. No.: 10/102,538

(22) Filed: Mar. 19, 2002

(65) Prior Publication Data

US 2002/0134021 A1 Sep. 26, 2002

(30) Foreign Application Priority Data

Mar. 21, 2001 (GB) ..... 0107064

(51) Int. Cl.[7] ..... E05F 15/16
(52) U.S. Cl. ..... 49/349; 49/374
(58) Field of Search ..... 49/349, 352, 348, 49/372, 374

(56) References Cited

U.S. PATENT DOCUMENTS

| | | | | | |
|---|---|---|---|---|---|
| 1,730,204 | A | * | 10/1929 | Harris | 160/37 |
| 3,568,366 | A | * | 3/1971 | Carella | 49/349 |
| 3,834,080 | A | * | 9/1974 | Lystad | 49/348 |
| 4,893,435 | A | * | 1/1990 | Shalit | 49/360 |
| 4,920,697 | A | * | 5/1990 | Vail et al. | 49/348 |
| 5,142,824 | A | * | 9/1992 | Le Compagnon et al. | 49/349 |
| 5,398,449 | A | * | 3/1995 | Kobrehel et al. | 49/352 |
| 5,505,022 | A | | 4/1996 | Shibata et al. | |
| 6,086,133 | A | * | 7/2000 | Alonso | 296/97.8 |
| 6,119,400 | A | | 9/2000 | Ovenshire | |

FOREIGN PATENT DOCUMENTS

| | | |
|---|---|---|
| DE | 1285358 | 12/1968 |
| WO | 9819034 | 5/1997 |

OTHER PUBLICATIONS

European Search Report for Application No. EP 02 25 1111 dated May 8, 2002.
UK Patent Office Search Report under Section 17 Date of search: Jul. 26, 2001.

* cited by examiner

*Primary Examiner*—Gregory J. Strimbu
(74) *Attorney, Agent, or Firm*—Carlson, Gaskey & Olds

(57) ABSTRACT

A vehicle window regulator including an elongate drive shaft having a drive axis and first and second drive sprockets connected at spaced locations to the drive shaft. The first and second drive sprockets may be connected to the drive shaft constant velocity joints. The first and second drive sprockets are connected to respective first and second idler wheels via respective first and second toothed drive belts, with each drive belt including a cursor for connection to a window glass.

15 Claims, 2 Drawing Sheets

VEHICLE WINDOW REGULATOR HAVING ANGLED SPROCKETS

This patent application claims priority to United Kingdom (GB) patent application number 0107064.8 filed on Mar. 21, 2001.

BACKGROUND OF THE INVENTION

The present invention relates to vehicle window regulators.

Vehicles are known which include passenger doors having windows with window glass which can be lowered to open the window and raised to close the window. The window glass is raised and lowered by a window regulator. The window regulator and associated guide rails must control the pitch, roll and yaw of the window glass and must also locate the window glass in the X (fore and aft) Y (lateral) and Z (vertical) directions.

Various window regulator mechanisms are known including single and dual arm regulators and single and twin cable operated regulators.

Modern vehicle side windows have curved glass (having an axis of curvature orientated substantially in the X direction) which when raised and lowered must be guided for rotation about the center of curvature of the glass. As such, when considering a side window on a car, the lower edge of the glass (where the window regulator is attached) must be allowed to move laterally relative to the vehicle. Window regulators must therefore allow for such lateral movement.

Furthermore, on some modern vehicles the window glass is designed to move slightly rearwardly as the window glass is closed. Again the window regulator must allow for this movement.

A problem with known window regulators is that a window regulator designed for a particular door is unlikely to be usable in a different door.

SUMMARY OF THE INVENTION

An object of the present invention to provide a window regulator which can be adapted for different installations.

A further object of the present invention is to provide a window regulator which is simple and reliable in operation.

The present invention meets these objects and comprises a vehicle window regulator with an elongate drive shaft. The drive shaft has a drive axis connected at spaced locations to a first and a second drive sprocket. Each drive sprocket is connected via a first and second toothed drive belt to respective first and second idler wheels. Each drive belt includes a cursor for connection to a window glass.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
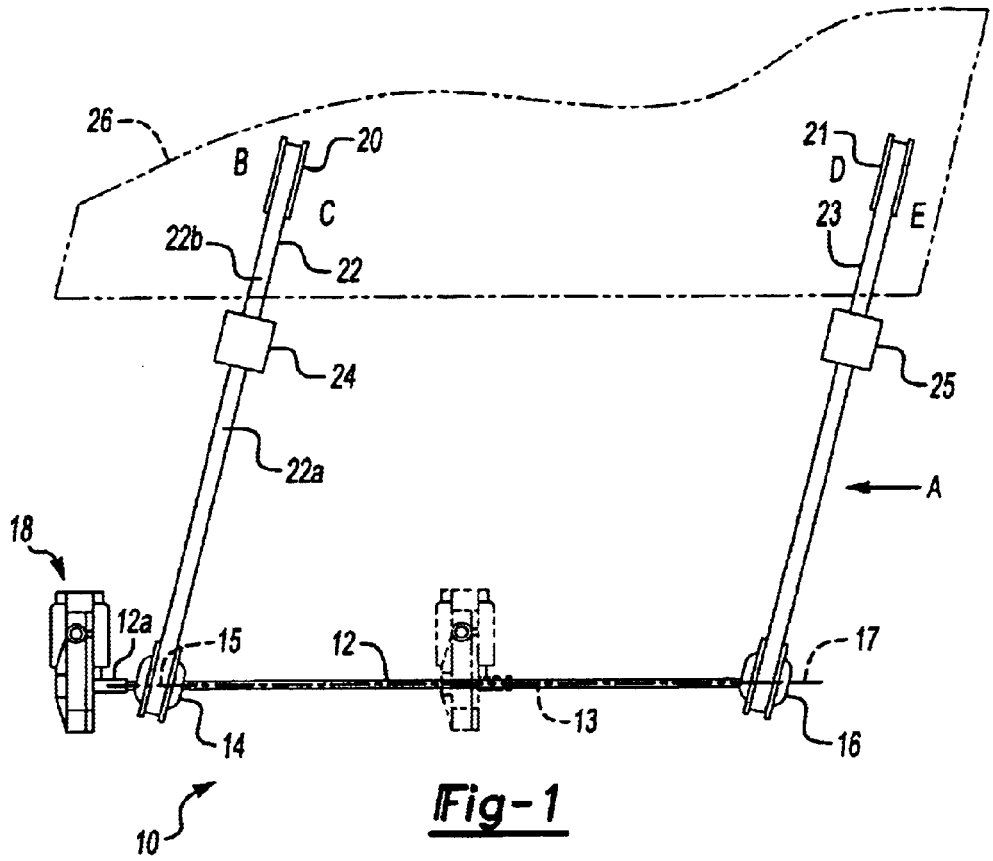
FIG. 1 is a side view of a window regulator according to the present invention.
Figure 2:
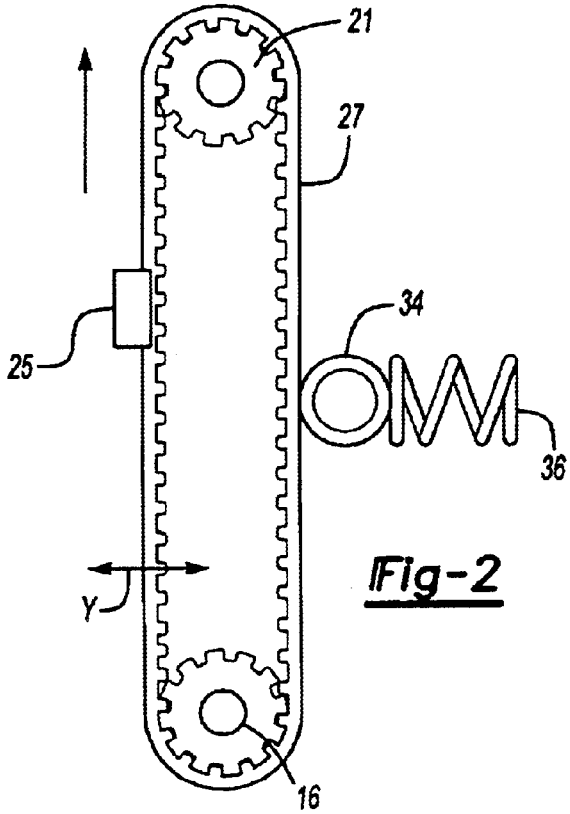
FIG. 2 is a view of the window regulator of FIG. 1 taken in the direction of arrow A.

With reference to FIGS. 1 and 2, there is shown a window regulator 10 including a drive shaft 12 having a drive shaft axis 13.

Mounted on drive shaft 12, at spaced locations, is a first drive sprocket 14 rotatable about sprocket axis 15 and a second drive sprocket 16 rotatable about sprocket axis 17.

Each drive sprocket is drivingly connected to the drive shaft by a constant velocity joint, in this case a Rzeppa type ball joint.

The drive shaft 12 is of hexagonal cross section and drivably engages the bores of the Rzeppa ball joint. The outside of the Rzeppa ball joints are drivably connected to the drive sprockets. As such rotation of drive shaft 12 causes corresponding rotation of drive sprockets 14 and 16.

A motor is drivingly connected to end 12A of shaft 12.

An idler wheel 20 is positioned remote from the drive sprocket 14.

A toothed belt 22 connects drive sprocket 14 and idler wheel 20.

Secured to toothed belt 22 is a cursor 24.

A similar arrangement of idler wheel 21, toothed belt 23 and cursor 25 is associated with drive sprocket 16.

A window glass 26 (shown chain dotted) is connected either directly or via connectors (not shown) to cursors 24 and 25.

The teeth 32 of belts 22 and 23 engage corresponding teeth on drive sprockets 14 and 16. However, wheels 20 and 21 may or may not include teeth.

FIGS. 3A to 3D show a method of connecting end 22A of toothed belt 22 to cursor 24.

Cursor 24 includes a portion 26 having a mouth 28. One side of mouth 28 includes an array of teeth 30 corresponding to teeth 32 of toothed belt 22.

Figure 3A:
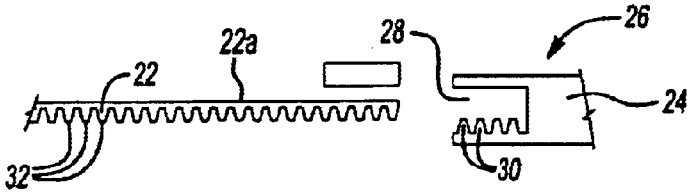
FIG. 3A is a representative diagram showing various components of the window regulator to be connected together.
Figure 3B:
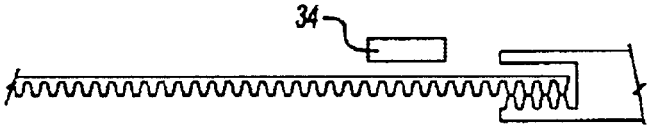
FIG. 3B is a representative diagram illustrating a toothed belt being inserted into a mouth of a cursor.

It can be seen from FIG. 3B that end 22A of toothed belt 22 is inserted into mouth 28.

Figure 3C:
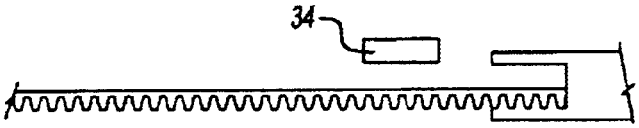
FIG. 3C is a representative diagram illustrating an array of teeth in the belt being engaged by an array of teeth engaged in the mouth of the cursor.
Figure 3D:
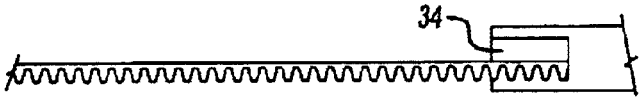
FIG. 3D is a representative diagram of a wedge inserted into the mouth of the cursor.

FIG. 3C shows the array of teeth 30 of mouth 28 having been engaged by teeth 32 of toothed belt 22.

A wedge 34 is then inserted into mouth 28 (see FIG. 3D) to ensure teeth 30 and 32 remain engaged. A similar arrangement is used to secure end 22B of belt 22 to a further portion of cursor 24, and cursor 25 is identical to cursor 24 in this regard.

A tensioning wheel 34 (shown schematically in FIG. 2) is spring loaded by spring 36 on to belt 23. This ensures the belt is kept under tension and allows for manufacturing tolerance errors and also for the cursor 25 to move laterally (in the Y direction) relative to an associated vehicle as the curved window glass 26 rotates about its curved axis as it is raised and lowered.

A similar arrangement of tensioning wheel and spring is used on belt 22.

Operation of the vehicle window regulator is as follows.

Motor 18 is selectively operated to rotate in a clockwise direction when viewing FIG. 2 such that shaft 12 is also rotated in a clockwise direction. This results in drive sprockets 14 and 16 also rotating in a clockwise direction and driving belts 22 and 23 and hence causing cursors 24 and 25 move towards idler wheels 20 and 21 respectively, thus closing the window.

By powering motor 18 in an opposite direction the window can be caused to open.

The invention is adaptable to fit in different installations.

Thus, belts 22 and 23 can both be cut shorter or cut longer to fit within different types of doors as to allow for different heights of window glass.

Belt 22 can be a different length to belt 23 in order to vary the position of wheel 20 relative to wheel 21, though window opening is limited by the shorter belt.

Axes 15 and 17 can be tilted more relative to axis 12 (thus moving idler wheels 20 and 21 to the right when viewing FIG. 1) to allow for a window glass which is designed to lift at a greater angle to the vertical. Alternatively axes 15 and 17 can be brought further in line with including parallel with axis 13 where the associated window glass lifts more vertically.

During assembly, drive sprocket 14 is slid on to shaft 12 and can be positioned at various locations along shaft 12, as can drive sprocket 16. This allows for the varying of the distance between cursors 24 and 25 for different lengths of window glass.

Furthermore, it can be seen that motor 18 could be positioned either between drive sprockets 14 and 16 or even to the right of drive sprocket 16 when viewing FIG. 1.

It is also possible to provide alternative or complementary belt tensioning systems.

Figure 6:
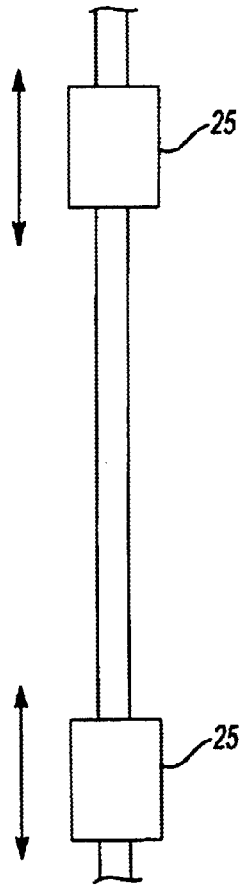
FIG. 6 is a representative diagram of an alternative belt and cursor arrangement.

Thus, idler wheels 20 and 21 can be resiliently biased away from corresponding drive sprockets 14 and 16 to provide for belt tensioning. This method is particularly applicable where the toothed belts are endless belts.

Where the toothed belts have first and second ends connected to first and second portions of associated cursors then it is possible to bias the first and second portions of the cursor towards each other to effect belt tensioning, a representative view of which is shown in FIG. 6.

In an alternative embodiment idler wheel 20 or 21 could be a toothed wheel and could be driven by a motor. As such this allows the motor to be positioned at location B or C (with a toothed wheel 20) or at D or E (with a toothed wheel 21). This is particularly advantageous when differing installations have differing space envelopes.

It should be noted that the invention is not limited to being operated by a motor and, alternatively, a manual arrangement could be used to raise and lower the window glass.

The components shown in FIG. 1 (other than the window glass 26) can be assembled into their relative positions and held there by a support structure (not shown). The components and support structure can then be assembled and secured into the door, with the support structure remaining within the door.

Alternatively, the support structure can be a temporary support structure and once the components of FIG. 1 and support structure has been positioned within the door, the components of FIG. 1 can be secured to the door and the temporary support structure can then be removed from the door.

Figure 5:
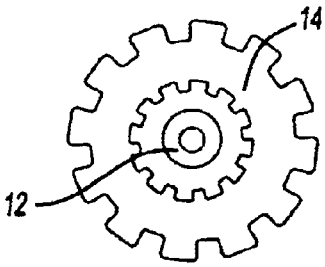
FIG. 5 is a representative diagram illustrating an alternative connection between a drive sprocket and a bore.

An alternative drive arrangement between the drive shaft and the sprocket would be a toothed periphery of the drive shaft which engages a toothed bore of the sprocket thereby allowing the shaft axis to be angled relative to the sprocket axis. An example of such a drive arrangement is shown in FIG. 5.

Figure 4:
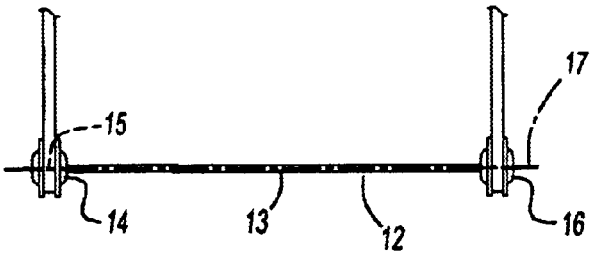
FIG. 4 is a representative diagram illustrating possible relationships between the drive sprockets.

Depending upon the installation and refinement of window glass raising and lowering required, constant velocity joints may not be required between the drive shaft and drive sprockets. In particular, where the axis of the drive sprocket is parallel to the axis of the drive shaft (as shown in FIG. 4) a simple hexagonal, square or other polygon or other non-circular shaft cross section can be used which engages with a corresponding bore of the sprocket to drive the sprocket.

The arrangement shown in FIG. 1 shows idler wheels being positioned generally above the drive shaft and drive sprockets. Depending upon the installation the drive shaft and drive sprockets could be positioned above the idler wheels.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A vehicle window regulator, comprising:

an elongate drive shaft having a drive axis;

first and second drive sprockets mounted at spaced locations on the drive shaft and surrounding the drive shaft;

first and second toothed drive belts;

first and second idler wheels connected to the first and second drive sprockets via the first and second drive belts, respectively;

first and second cursors on the first and second drive belts, respectively, for connection to a window glass, wherein the drive sprockets are connected to and are driven by the drive shaft via respective first and second drive connections which enable axes of the first and second drive sprockets to be angled relative to the drive axis of the drive shaft that the drive sprockets surround.

2. A vehicle window regulator as defined in claim 1, wherein a cross-section of the drive shaft has a non-circular shape.

3. A vehicle window regulator as defined in claim 1, wherein a position of at least one of the first and second drive sprockets is adjustable along the drive shaft axis.

4. A vehicle window regulator as defined in claim 1, wherein the drive sprockets axes are parallel to the drive shaft axis.

5. A vehicle window regulator as defined in claim 1, wherein the drive connections are constant velocity drive connections.

6. A vehicle window regulator as defined in claim 1, wherein each drive connection is defined by an army of teeth on the drive shaft engaging an array of teeth in a bore of the drive sprocket.

7. A vehicle window regulator as defined in claim 1, wherein the first and second drive belts are endless belts.

8. A vehicle window regulator as defined in claim 1, wherein at least one of the first and second drive belts includes a first end connected to a first portion of the respective cursor and a second end connected to a second portion of the respective cursor.

9. A vehicle window regulator as defined in claim 8, wherein the teeth of the respective cursor second drive belts engage teeth of at least one of the first and to effect a connection there between.

10. A vehicle window regulator as defined in claim 8, wherein the first and second portions of the respective cursor are elastomerically biased towards each other to provide drive belt tensioning.

11. A vehicle window regulator as defined in claim 1, wherein the first and second idler wheels are biased away from the respective first and second drive sprockets to provide for belt tensioning.

12. A vehicle window regulator as defined in claim 1, further comprising first and second tensioning wheels that act on the first and second drive belts to provide drive belt tensioning.

13. A vehicle window regulator as defined in claim 1, further comprising a motor operably connected to the drive shaft.

14. A vehicle window regulator as defined in claim 13, wherein one of the first and second drive sprockets is situated between the other of the first and second drive sprockets and the motor.

15. A vehicle window regulator as defined in claim 13, wherein the motor is situated between the first and second drive sprockets.

* * * * *

UNITED STATES PATENT AND TRADEMARK OFFICE

CERTIFICATE OF CORRECTION

PATENT NO. : 6,779,307 B2
DATED : August 24, 2004
INVENTOR(S) : Dobson

It is certified that error appears in the above-identified patent and that said Letters Patent is hereby corrected as shown below:

Column 4,
Line 65, "army" should read as -- array --

Signed and Sealed this

Thirtieth Day of November, 2004

JON W. DUDAS
*Director of the United States Patent and Trademark Office*